US007001443B2

(12) United States Patent
Woodfield et al.

(10) Patent No.: US 7,001,443 B2
(45) Date of Patent: Feb. 21, 2006

(54) METHOD FOR PRODUCING A METALLIC ALLOY BY THE OXIDATION AND CHEMICAL REDUCTION OF GASEOUS NON-OXIDE PRECURSOR COMPOUNDS

(75) Inventors: Andrew Philip Woodfield, Cincinnati, OH (US); Eric Allen Ott, Cincinnati, OH (US); William Thomas Carter, Jr., Galway, NY (US)

(73) Assignee: General Electric Company, Schenectady, NY (US)

( * ) Notice: Subject to any disclaimer, the term of this patent is extended or adjusted under 35 U.S.C. 154(b) by 247 days.

(21) Appl. No.: 10/329,141

(22) Filed: Dec. 23, 2002

(65) Prior Publication Data

US 2004/0118246 A1 Jun. 24, 2004

(51) Int. Cl.
*B22F 9/28* (2006.01)

(52) U.S. Cl. ..... 75/351; 75/369; 419/1
(58) Field of Classification Search ..... 75/343, 75/35, 369, 351, 368; 419/1
See application file for complete search history.

(56) References Cited

U.S. PATENT DOCUMENTS

| | | | | | |
|---|---|---|---|---|---|
| 3,012,878 | A | | 12/1961 | Muller | |
| 4,046,853 | A | | 9/1977 | Robinson | |
| 4,373,947 | A | * | 2/1983 | Buttner et al. | 75/228 |
| 4,519,839 | A | * | 5/1985 | Toyoaki et al. | 75/242 |
| 4,525,206 | A | * | 6/1985 | Soled et al. | 75/351 |
| 4,916,107 | A | | 4/1990 | Brand et al. | |
| 4,940,572 | A | * | 7/1990 | Laundon et al. | 423/633 |
| 5,196,181 | A | * | 3/1993 | Hartmann | 423/613 |
| 5,322,666 | A | | 6/1994 | Watwe | |
| 5,462,686 | A | * | 10/1995 | Sugiyama et al. | 252/62.62 |
| 5,599,519 | A | * | 2/1997 | Haddow | 423/613 |
| 5,779,761 | A | | 7/1998 | Armstrong et al. | |
| 5,930,580 | A | | 7/1999 | Everett | |
| 5,958,106 | A | | 9/1999 | Armstrong et al. | |
| 6,406,532 | B1 | | 6/2002 | Hartmann et al. | |

FOREIGN PATENT DOCUMENTS

| | | |
|---|---|---|
| EP | 0 255 616 A1 | 2/1988 |
| GB | 756 497 | 9/1956 |
| GB | 1 092 034 | 11/1967 |
| WO | WO 99/64638 | 12/1999 |

* cited by examiner

*Primary Examiner*—Ngoclan T. Mai
(74) *Attorney, Agent, or Firm*—McNees Wallace & Nurick LLC

(57) ABSTRACT

A metallic alloy is prepared from a gaseous mixture of at least two non-oxide precursor compounds, wherein the non-oxide precursor compounds collectively comprise the metallic constituents. The mixture of the non-oxide precursor compounds is oxidized to form a solid mixed metallic oxide. The solid mixed metallic oxide is chemically reduced to produce the metallic alloy.

22 Claims, 2 Drawing Sheets

20
FURNISH GASEOUS MIXTURE
24
ADD MODIFYING CONSTITUENT
22
OXIDIZE MIXTURE TO PRODUCE MIXED METALLIC OXIDE
25
PRE-CONSOLIDATE MIXED METALLIC OXIDE (OPTIONAL)
26
CHEMICALLY REDUCE TO PRODUCE METALLIC ALLOY
28
FURTHER PROCESS METALLIC ALLOY
30
CONSOLIDATE METALLIC ALLOY
32
MELT AND SOLIDIFY METALLIC ALLOY
34
FINAL PROCESS

METHOD FOR PRODUCING A METALLIC ALLOY BY THE OXIDATION AND CHEMICAL REDUCTION OF GASEOUS NON-OXIDE PRECURSOR COMPOUNDS

This invention relates to the production of metallic alloys and metallic-alloy articles and, more particularly, to their production from solutions of the metallic constituents.

BACKGROUND OF THE INVENTION

Metallic articles are fabricated by any of a number of techniques, as may be appropriate for the nature of the metal and the article. In one common approach, metal-containing ores are refined to produce a molten metal, which is thereafter cast. The metal is refined as necessary to remove or reduce the amounts of undesirable minor elements. The composition of the refined metal is usually modified by the addition of desirable alloying constituents. These refining and alloying steps may be performed during the initial melting process or after solidification and remelting. After a metal of the desired composition is produced, it may be used in the as-cast form for some alloy compositions (i.e., cast alloys), or further mechanically worked to form the metal to the desired shape for other alloy compositions (i.e., wrought alloys), or processed through another physical form (i.e., powder which is thereafter consolidated). In these approaches, further processing such as heat treating, machining, surface coating, and the like may also be employed.

Some metallic alloys arc relatively straightforward to produce by this general approach. The alloying elements are thermophysically compatible in the molten state, so that the alloys may be produced by melting and processing. However, in the subsequent processing operations complications may develop. The cast or cast-and-worked alloys may exhibit irregularities in macrostructure and microstructure that interfere with the realization of the potential properties of the alloys. For example, there may be extensive defect structures, there may be chemical inhomogeneities, there may be a tendency to cracking that reduces the fatigue life of the final product, it may not be possible to inspect the product sufficiently, and/or the grain size may be too large to impart the desired properties. The costs of production may be high and prohibitive for some applications.

The production of other metallic alloys is complicated in many cases by the differences in the thermophysical properties of the elemental metallic constituents being combined to produce the alloy. The interactions and reactions due to these thermophysical properties of the metallic constituents may cause undesirable results. In one commercially important example, titanium alloys must be melted in a vacuum because of their reactivity with oxygen and nitrogen in the air. In the work leading to the present invention, the inventors have realized that the necessity to melt under a vacuum makes it difficult to utilize some desirable alloying elements due to the differences in their relative vapor pressures in a vacuum environment. The difference in the vapor pressures is one of the thermophysical properties that must be considered in alloying titanium. In other cases, the metallic alloying constituents may be thermophysically incompatible with the molten titanium because of other thermophysical characteristics such as melting points, liquid-phase immiscibility, densities, chemical reactivities and the tendency of strong beta stabilizers to segregate. Some of the incompatibilities may be overcome with the use of expensive master alloys, but this approach is not applicable in other cases. And even where the thermophysical incompatibilities are overcome, there may be difficulty in achieving homogeneity in the alloys due to the manner of melting.

Thus, there is a need for an improved approach to producing alloys of titanium and other metals, with added metallic alloying constituents. The need extends both to conventional meltable alloys, where macrostructural and microstructural limitations must be overcome, and non-meltable alloys, in which the previous alloying limitations are overcome and the alloys may be made highly homogeneous. The present invention fulfills this need, and further provides related advantages.

BRIEF SUMMARY OF THE INVENTION

The present approach provides a technique for producing a metallic alloy having at least two metallic constituents, and articles made from the metallic alloy. The approach circumvents the commonly encountered macrostructural, microstructural, thermophysical-incompatibility, and other types of problems that make the manufacture of the most-desirable forms of many types of alloys difficult or impossible. The resulting metallic alloys are substantially fully homogeneous, but may be subsequently processed using conventional thermomechanical and other techniques.

A method for producing a metallic alloy having at least two metallic constituents comprises first furnishing a gaseous mixture of at least two non-oxide precursor compounds, wherein the non-oxide precursor compounds collectively comprise the metallic constituents. The mixture of the non-oxide precursor compounds is thereafter oxidized to form a solid mixed metallic oxide. The step of oxidizing is performed at a temperature greater than room temperature but less than a melting temperature of the mixed metallic oxide. The resulting mixed metallic oxide is thereafter chemically reduced to produce the metallic alloy. As used herein, the term "metallic alloy" includes both conventional metallic alloys and intermetallic compounds formed of metallic constituents.

The gaseous mixture may include a base metal constituent, present in an amount by weight greater than any other metallic constituent, selected from the group consisting of titanium, aluminum, nickel, iron, and cobalt. The base metal constituent is preferably, but not necessarily, present in an amount of at least 50 percent by weight of a total weight of the metallic constituents. The most preferred base metal constituent is titanium. The use of the present approach is not, however, limited to these base-metal alloy systems.

The non-oxide compounds are of any operable type. One or more of the non-oxide precursor compounds is preferably furnished as a metal salt, more preferably a metal halide, and most preferably a metal chloride. In the case of the titanium alloys of most interest, the titanium is most preferably furnished as titanium chloride (also termed titanium tetrachloride, $TiCl_4$), and the alloying elements are preferably furnished as metallic chlorides as well.

The metallic alloy is in any operable physical form, but is preferably a finely divided particulate. The solid mixed metallic oxide may be chemically reduced by any operable approach, but is preferably chemically reduced by a solid-phase reduction technique such as fused salt electrolysis. The solid mixed metallic oxide may optionally be pre-consolidated prior to the chemical reduction.

After the metallic alloy is produced, it may be further processed by any operable approach. It may be consolidated to produce a consolidated metallic article. The consolidation or other further processing is performed in some cases without melting the consolidated metallic article. In other cases, melting and solidification may be used to achieve a cost reduction over present processing, but some of the benefits that are achieved when there is no melting are sacrificed.

In some instances, it may be desirable to introduce modifying elements into the metallic alloy that are not available or readily available as suitable precursor compounds. In that case, a modifying constituent may be added to the gaseous mixture of the non-oxide precursor compounds as they are oxidized or prior to the oxidation. Typically, such intentionally added modifying elements are present in relatively small amounts. For example, small amounts of solid pure metals or alloys in finely divided form may be added to the gaseous mixture as it is being oxidized. The additive is oxidized, at least in part, with the gaseous mixture of non-oxide precursor compounds.

In its preferred embodiment, the present approach produces substantially fully homogeneous metallic oxide alloy powders or spongy mass from a fully mixed gas. These metallic oxide powders or spongy mass are used in a chemical reduction from the oxide form to the metallic form. There are many other ways to produce masses of metallic alloy powders, such as melting followed by spray atomization of alloys, blending of powders of other alloys, mechanical alloying of non-alloyed or other composition of alloy powders, and the like. These other techniques suffer from the drawbacks that they require melting that does not allow alloying of thermophysically incompatible elements, require vacuum melting, or introduce extensive defect structures that cannot be readily removed by subsequent processing. The present approach, on the other hand, does not require melting of the metals, at least prior to the chemical reduction (although the metallic alloy may subsequently be melted). There is therefore no requirement for vacuum melting. The resulting metallic alloy may be made to be free of mechanical defects such as those introduced in mechanical alloying procedures.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
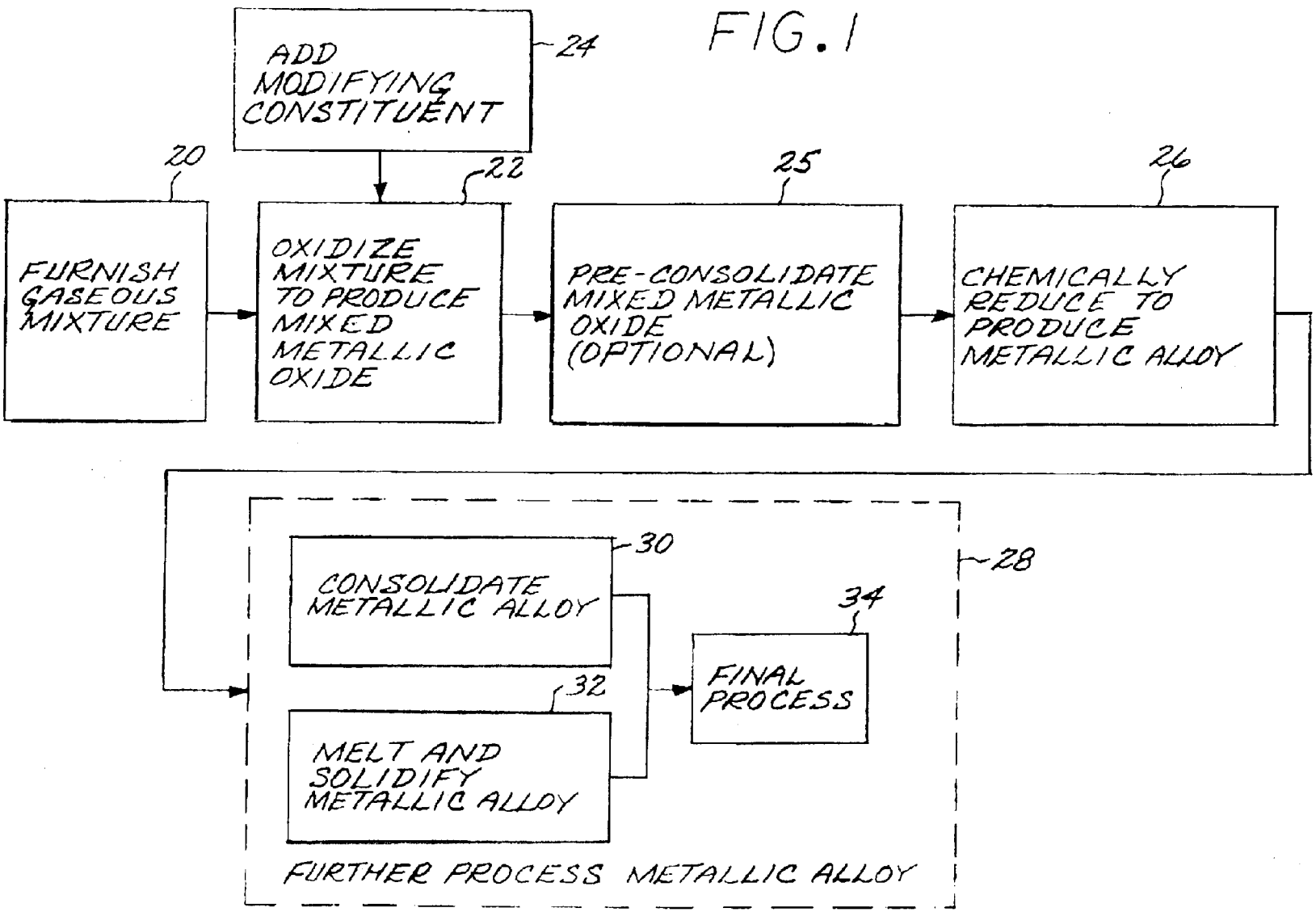
FIG. 1 is a block flow diagram of a preferred approach for practicing the invention.

The present approach, as illustrated in FIG. 1, is embodied in a method for producing a metallic material having at least two metallic constituents, commonly termed a "metallic alloy". As used herein, the term "metallic alloy" includes both conventional metallic alloys and intermetallic compounds formed of metallic constituents, such as approximately equiatomic TiAl. Relatively small amounts of non-metallic elements, such as boron, carbon, and silicon, may also be present. The approach includes furnishing a, gaseous mixture of at least two non-oxide precursor compounds, step 20. The non-oxide precursor compounds are preferably inorganic salts of the metallic elements (termed "metal salts"), more preferably inorganic halides of the metallic elements (termed "metal halides"), and most preferably, in the case of the preparation of titanium alloys, inorganic chlorides of the metallic elements (termed "metal chlorides"). (As used herein, sulfates, nitrates, and carbonates are considered to be "metal salts".) The non-oxide precursor compounds may not be the simple oxides of the metallic elements, although the non-oxide precursor compounds may contain some oxygen.

The non-oxide precursor compounds are mixed together to form a gaseous mixture. The non-oxide precursor compounds may initially be furnished as gases, or they may be furnished as solids or liquids that are vaporized, reacted, or otherwise transformed to the gaseous state. However they are initially furnished, the non-oxide precursor compounds form a gaseous mixture in which all constituents are well mixed together on the atomic level. This gaseous mixture ensures that the constituents of the mixed metallic oxide and the final metallic alloy are also well mixed on the atomic level. The gaseous mixture may exist at room temperature, or it may be necessary to heat the precursor compounds to cause the gaseous mixture to form.

The non-oxide precursor compounds collectively comprise each of the metallic constituents. That is, the non-oxide precursor compounds collectively contain all of the metallic elements of the metallic alloy, in the required proportions of the final metallic alloy, with the possible exception of modifying constituents discussed subsequently. The metallic elements may be supplied by the non-oxide precursor compounds in various ways. In the preferred approach, there is exactly one non-oxide precursor compound for each alloying element, and that one precursor compound provides all of the material for that respective metallic constituent in the alloy. That is, for a three-element metallic alloy that is the final result of the process, a first non-oxide precursor compound supplies all of the first element, a second non-oxide precursor compound supplies all of the second element, and a third non-oxide precursor compound supplies all of the third element. Alternatives are within the scope of the approach, however. For example, several of the non-oxide precursor compounds may together supply all of one particular metallic element. In another alternative, one non-oxide precursor compound may supply all or part of two or more of the metallic elements. The latter approaches are less preferred, because they make more difficult the precise determination of the elemental proportions in the final metallic alloy.

One of the advantages of the present approach is that techniques exist to make high purity gaseous compounds of a wide range of metals, which then may be used as the precursor compounds in the present approach. Consequently, the mixture of the precursor compounds is also of high purity, and without impurity elements that are often present in metals produced directly from ores by crucible-based techniques and may be extremely difficult to remove by conventional techniques. As the understanding of metallic alloys has progressed and the uses of the metallic alloys have become ever-more demanding, it has been found that the presence of such minor impurity elements may be the limiting consideration in some metallic alloys. The present approach thus produces high-purity alloys that by-pass these limitations, because all elements that are present are intentionally added.

The selection of the specific non-oxide precursor compounds is dependent upon the specific metallic constituents and proportions of the final metallic alloy. In the preferred approach, the base metal constituent of the final metallic alloy, present in an amount by weight greater than any other metallic constituent, is titanium, aluminum, nickel, iron, or cobalt, but most preferably titanium, but other base metals are operable as well. In the presently preferred embodiment, titanium is present in an amount by weight greater than any other metallic constituent. In a common situation, the base metal is present in an amount of at least 50 percent by weight of a total weight of the metallic constituents.

To make a titanium-base metallic alloy by the present approach, the preferred non-oxide precursor compounds are inorganic chlorides of the metals. To cite a specific example, a preferred metallic alloy of particular interest is Ti-6Al-4V, which contains about 6 weight percent aluminum, about 4 weight percent vanadium, balance titanium and minor elements. To make a Ti-6Al-4V metallic alloy, the titanium is supplied by gaseous titanium chloride ($TiCl_4$), the aluminum is supplied by gaseous aluminum chloride ($AlCl_3$), and the vanadium is supplied by gaseous vanadium chloride ($VCl_4$), all furnishing the proper proportions of titanium, aluminum, and vanadium.

Figure 2:
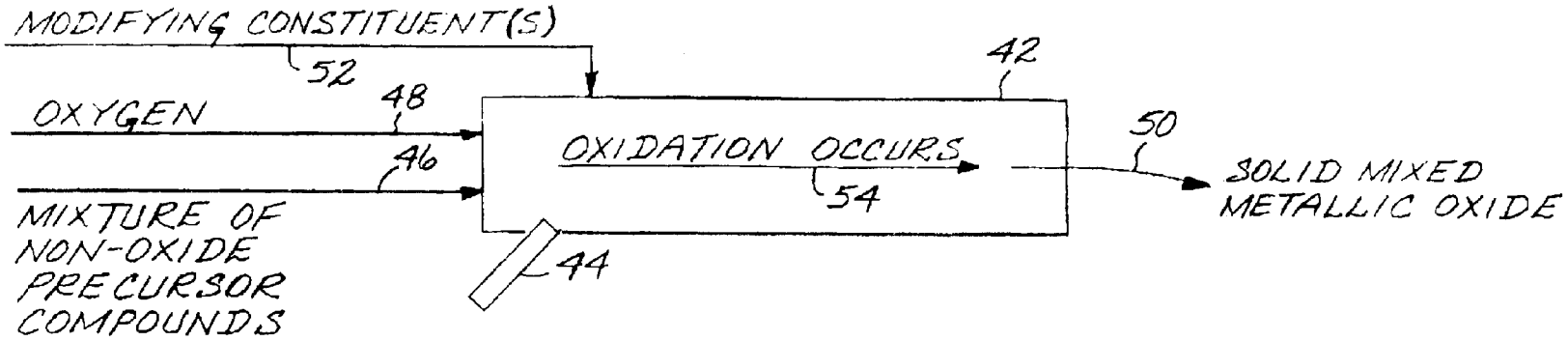
FIG. 2 is a schematic view of a reactor for performing the oxidation step.

The mixture of the non-oxide precursor compounds is oxidized to form a solid mixed metallic oxide, step 22. The step of oxidizing is performed at a temperature greater than room temperature but less than a melting temperature of the mixed metallic oxide. The oxidation may be performed in batch, continuous, or semi-continuous fashion. FIG. 2 schematically depicts a continuous-flow reactor 40 for performing the oxidation of the non-oxide precursor compounds. The reactor 40 has a reaction tube 42 within which the oxidation occurs. The oxidation temperature is greater than room temperature but less than a melting temperature of the mixed metallic oxide that is to be formed. The oxidation reaction in the reaction tube 42 is initiated by any operable approach, such as a plasma torch 44 or a spark source. After initiation, the reaction is preferably exothermic and self sustaining, with heat and the gaseous reaction products (e.g., chlorine gas) evolved. However, a heating source may be provided if necessary. The gaseous mixture of the non-oxide precursor compounds is injected at one end of the reaction tube 42, at numeral 46, and flows along its length. An oxygen-containing gas is also injected into the reaction tube 42, at numeral 48. The mixture of the non-oxide precursor compounds and the oxygen mix together, causing the precursor compounds to oxidize and give up their salt (e.g., halide) constituent as they flow along the reaction tube 42, see numeral 54. The resulting mixed oxide, which has a higher melting temperature than the oxidation temperature, is produced as a solid, at numeral 50.

Some modifying constituents (metals or nonmetals) of interest that are to be intentionally present in the mixed oxide and the final metallic alloy may not form appropriate, stable, and compatible gaseous compounds, or may have gaseous compounds that are very expensive to produce. These elements may be added, step 24 of FIG. 1, as a condensed phase (i.e., solid or liquid form) or vapor either in the elemental form or as a compound, as shown at numeral 52 in FIG. 2. It is appropriate to add only minor amounts of the modifying constituents, so that they may mix with and be oxidized concurrently with the precursor compounds and also so that the final metallic alloy remains metallic in character if the modifying constituent is not a metal. The modifying element or elements are injected into the oxidizing flow 54 of the precursor compounds, and also oxidize as they mix and flow with the oxidizing flow 54. Examples of such modifying constituents include metals such as molybdenum, chromium, niobium, and tantalum, and nonmetals such as silicon and carbon. The modifying constituents may be supplied in elemental form, or in compounds such as nitrates, carbonates, and sulfates.

The input streams 46, 48, and 52 are illustrated as being added to the reaction tube 42 separately. They may instead be pre-mixed prior to addition in any pairwise fashion or all together.

The solid mixed metallic oxide resulting from oxidation has the non-oxide constituents mixed on an atomic or near-atomic level. The "mixed metallic oxide" is typically not a single stoichiometric oxide, but is more typically a complex single-phase oxide or an intimate mixture of several oxides present in two or more phases. The exact physical form of the solid mixed metallic oxide is not important. Instead, it is important that the mixture is formed on such a fine scale. In an alternative approach to the forming of alloys that is not within the scope of the present approach, oxides may be furnished as separate particles—for example, particles of titanium oxide, aluminum oxide, and vanadium oxide. These oxide particles are of a size on the order of micrometers or larger. The oxide particles are mixed together and then further processed by reduction. The resulting metallic alloys typically contain compositional inhomogeneities on the scale of the original particle sizes. Such compositional inhomogeneities may be acceptable in some applications but are unacceptable in others, particularly where the metallic alloy is not to be subsequently melted, given an extremely long diffusion homogenization, or the various elements do not readily interdiffuse during even long homogenization treatments. The present approach avoids this problem, producing a metallic alloy that is homogeneous on the atomic level, and also allowing the production of micro-alloyed metallic alloys that cannot be produced otherwise. This high degree of homogeneity is as good as, or in some instances better than, the state produced by melting and casting. There are homogeneity limitations in the casting and melting of metallic alloys, due to elemental segregation during solidification and because some elements are immiscible or otherwise difficult or impossible to incorporate in a homogeneous metallic alloy.

Optionally, the mixed metallic oxides may be pre-consolidated, step 25, prior to chemical reduction. The pre-consolidation leads to the production of a sponge in the subsequent processing, rather than particles. The pre-consolidation is performed by any operable approach, such as pressing the nonmetallic precursor compounds into a pre-consolidated mass.

The solid mixed metallic oxide is thereafter chemically reduced to produce the metallic alloy, step 26 of FIG. 1. (As used herein, chemical reduction is the inverse of chemical oxidation.) The chemical reduction may be by any operable approach. The chemical reduction is preferably a solid phase approach, wherein the metallic constituents are never melted. In a most-preferred solid phase chemical reduction approach, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixed metallic oxide, preferably furnished in a finely divided solid form but optionally as a pre-compressed mass, is immersed in an electrolysis cell in a fused salt electrolyte such as a chloride salt at a temperature below the melting temperature of the alloy that forms from the nonmetallic precursor compounds. The mixed metallic oxide is made the cathode of the electrolysis cell, with an inert anode. The oxygen combined with the metallic elements is partially or completely removed from the mixture by chemical reduction. The reaction is performed at an elevated temperature to accelerate the diffusion of the oxygen or other gas away from the cathode. The cathodic potential is controlled to ensure that the reduction of the mixed metallic oxide will occur, rather than other possible chemical reactions such as the decomposition of the molten salt. The electrolyte is a salt, preferably a salt that is more stable than the equivalent salt of the metals being refined and ideally very stable to remove the oxygen or other gas to a desired low level. The chlorides and mixtures of chlorides of barium, calcium, cesium, lithium, strontium, and yttrium are preferred as the electrolyte. The chemical reduction is preferably, but not necessarily, carried to completion, so that the mixed metallic oxide is completely reduced. Not carrying the process to completion is a method to control the oxygen content of the metallic alloy produced.

The mixed metallic oxide, and thence the metallic alloy, are preferably produced as a finely divided particulate form, or as a pre-consolidated mass if step 25 is employed. The pre-consolidated mass may be prepared to a near net shape of a final article, or oversize to allow subsequent consolidation.

The metallic alloy may be further processed, step 28. The further processing, if performed, may be of any operable type. Most preferably, the metallic alloy is consolidated to produce a consolidated metallic article, step 30. The finely divided metallic alloy is consolidated into a metallic article by any operable approach. Examples include hot or cold pressing, hot isostatic pressing, canned extrusion, a combination of canned extrusion and forging, and the like. Such procedures are known in the art for processing starting material in finely divided particulate form, and they may be used in relation to the metallic alloy. The preferred consolidation is accomplished without melting the metallic alloy and without melting the consolidated metallic article. Such melting might introduce defects and microstructural inhomogeneities that are otherwise absent due to the approach for reaching the metallic alloy of step 26.

Figure 3:
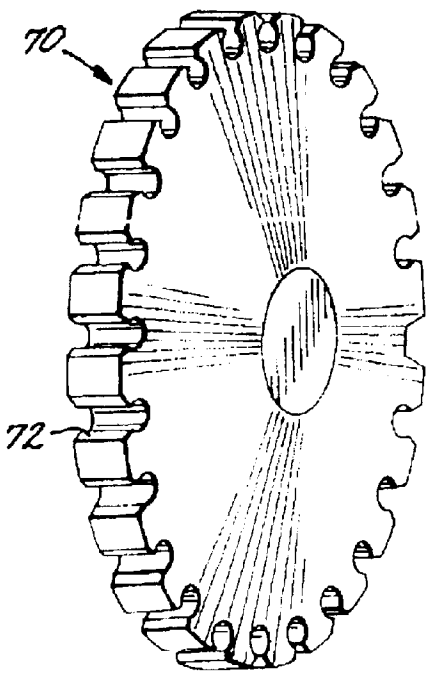
FIG. 3 is a perspective view of a metallic article prepared by the present approach.

FIG. 3 depicts an example of a consolidated metallic article 70, in this case a component of a gas turbine engine. The illustrated consolidated metallic article 70 is a compressor disk or a fan disk, with slots 72 in the rim that are subsequently machined after the consolidation. A respective compressor blade or fan blade is received into each slot 72.

Alternatively, the metallic alloy may be melted and solidified, step 32, preferably without mechanical comminution of the metallic alloy. The melting and solidification approach is not preferred, because it may lead to the very type of alloy inhomogeneity that the steps 20–26 take care to avoid. However, in some specific applications melting and solidification may be used.

The article resulting from steps 30 or 32 is optionally final processed, step 34, by any operable approach. Such final processing may include, for example, cleaning, coarse and/or fine machining, applying a coating or other surface treating.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for producing a metallic alloy having at least two metallic constituents, comprising the steps of furnishing a gaseous mixture of at least two non-oxide precursor compounds, wherein the non-oxide precursor compounds collectively comprise the metallic constituents; thereafter oxidizing the mixture of the non-oxide precursor compounds to form a solid mixed metallic oxide, wherein the step of oxidizing is performed at a temperature greater than room temperature but less than a melting temperature of the mixed metallic oxide; and thereafter chemically reducing the solid mixed metallic oxide to produce the metallic alloy.

2. The method of claim 1, wherein the step of furnishing the gaseous mixture includes the step of furnishing the non-oxide precursor compounds wherein a base metal constituent, present in an amount by weight greater than any other metallic constituent, is selected from the group consisting of titanium, aluminum, nickel, iron, and cobalt.

3. The method of claim 1, wherein the step of furnishing the gaseous mixture includes the step of furnishing the non-oxide precursor compounds wherein a base metal constituent, present in an amount by weight greater than any other metallic constituent, is titanium.

4. The method of claim 1, wherein the step of furnishing the gaseous mixture includes the step of furnishing at least one of the non-oxide precursor compounds as a metal salt.

5. The method of claim 1, wherein the step of furnishing the gaseous mixture includes the step of furnishing at least one of the non-oxide precursor compounds as a metal halide.

6. The method of claim 1, wherein the step of furnishing the gaseous mixture includes the step of furnishing at least one of the non-oxide precursor compounds as a metal chloride.

7. The method of claim 1, wherein the step of chemically reducing includes the step of producing the metallic alloy as a finely divided particulate form.

8. The method of claim 1, wherein the step of chemically reducing includes the step of chemically reducing the solid mixed metallic oxide by solid-phase reduction.

9. The method of claim 1, wherein the step of chemically reducing includes the step of chemically reducing the solid mixed metallic oxide by fused salt electrolysis.

10. The method of claim 1, wherein the method includes an additional step, after the step of chemically reducing, of consolidating the metallic alloy to produce a consolidated metallic article.

11. The method of claim 1, wherein the method includes an additional step, after the step of chemically reducing, of consolidating the metallic alloy to produce a consolidated metallic article, without melting the metallic alloy and without melting the consolidated metallic article.

12. The method of claim 1, wherein the method includes an additional step, after the step of chemically reducing, of melting and solidifying the metallic alloy.

13. The method of claim 1, wherein the method includes an additional step, performed concurrently with the step of oxidizing, of adding a modifying constituent to the gaseous mixture of the non-oxide precursor compounds.

14. The method of claim 1, including an additional step, after the step of oxidizing and prior to the step of chemically reducing, of pre-consolidating the solid mixed metallic oxide.

15. A method for producing a metallic alloy having at least two metallic constituents, comprising the steps of furnishing a gaseous mixture of at least two non-oxide precursor compounds, wherein the non-oxide precursor compounds collectively comprise the metallic constituents, and wherein a base metal constituent, present in an amount by weight greater than any other metallic constituent, is titanium present as titanium chloride; thereafter oxidizing the mixture of the non-oxide precursor compounds to form a solid mixed metallic oxide, wherein the step of oxidizing is performed at a temperature greater than room temperature but less than a melting temperature of the solid mixed metallic oxide; and thereafter chemically reducing the solid mixed metallic oxide to produce the metallic alloy.

16. The method of claim 15, wherein the step of furnishing includes the step of mixing at least one other metallic chloride with the titanium chloride.

17. The method of claim 15, wherein the step of chemically reducing includes the step of chemically reducing the solid mixed metallic oxide by solid-phase reduction.

18. The method of claim 15, wherein the method includes an additional step, after the step of chemically reducing, of consolidating the metallic alloy to produce a consolidated metallic article.

19. The method of claim 15, wherein the method includes an additional step, after the step of chemically reducing, of consolidating the metallic alloy to produce a consolidated metallic article, without melting the metallic alloy and without melting the consolidated metallic article.

20. The method of claim 15, wherein the method includes an additional step, performed concurrently with the step of oxidizing, of adding a solid modifying constituent to the gaseous mixture of the non-oxide precursor compounds they are oxidized.

21. The method of claim 15, wherein the method includes an additional step, after the step of chemically reducing, of melting and solidifying the metallic alloy.

22. The method of claim 1, wherein the step of furnishing the gaseous mixture includes step of furnishing the non-oxide precursor compounds wherein a base metal constituent, present in an amount by weight greater than any other metallic constituent, is selected from the group consisting of titanium, aluminum, nickel, and cobalt.

* * * * *